US006571752B1

(12) United States Patent
Suzuki

(10) Patent No.: US 6,571,752 B1
(45) Date of Patent: Jun. 3, 2003

(54) COOLING SYSTEM AND METHOD FOR AN INTERNAL COMBUSTION ENGINE

(75) Inventor: Makoto Suzuki, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/711,098

(22) Filed: Nov. 14, 2000

(30) Foreign Application Priority Data

Nov. 18, 1999 (JP) ..... 11-328125

(51) Int. Cl.[7] ..... F01P 11/02
(52) U.S. Cl. ..... 123/41.14; 123/142.5 R
(58) Field of Search ..... 123/41.14, 142.5 R, 123/142.5 E

(56) References Cited

U.S. PATENT DOCUMENTS 6,178,929 B1 * 1/2001 Schatz ..... 123/41.14

FOREIGN PATENT DOCUMENTS

| | | |
|---|---|---|
| JP | 9-11731 | 1/1997 |
| JP | 10-71837 | 3/1998 |

* cited by examiner

*Primary Examiner*—Noah P. Kamen
(74) *Attorney, Agent, or Firm*—Oliff & Berridge, PLC

(57) ABSTRACT

A cooling system and method for an internal combustion engine including a controller for varying the rate of the cooling water. The controller varies the flow rate of cooling water by setting the flow rate of the cooling water to high when the controller determines that a hot water heating control is to be performed. The controller sets the flow rate of the cooling water to low when the controller determines that a heat accumulating control is to be performed; and the controller sets the flow rate of the cooling water to intermediate when the controller determines that a heating mode is to be performed.

10 Claims, 2 Drawing Sheets

COOLING SYSTEM AND METHOD FOR AN INTERNAL COMBUSTION ENGINE

BACKGROUND OF THE INVENTION

1. Field of Invention

This invention relates generally to a water cooling system for an internal combustion engine, and more particularly to a cooling system and method for warming-up the engine at an early stage.

2. Description of Related Art

In an internal combustion engine for a vehicle, it is desirable to improve the performance of fuel consumption and to reduce an emission of an exhaust gas during early warm-up when starting the engine.

In conventional cooling systems for an internal combustion engine which include a heat accumulating container, a flow rate of the cooling water flowing to the internal combustion engine from the heat accumulating container is limited to the same flow rate that high-temperature cooling water, reserved in the heat accumulating container, flows into the heat accumulated container. Thus, warm-up of the internal combustion engine can only be performed by supplying the high-temperature cooling water reserved in the heat accumulating container at the same rate that it is being reserved therein. As a result, heating of the engine is inefficient because the heat provided to the internal combustion engine during warming-up operation is not efficiently accumulated in the engine.

It is an object of the present invention to solve the problems inherent in the prior art, such as e.g., by speeding up the warm-up process by increasing the flow rate of the high-temperature cooling water flowing through the internal combustion engine.

SUMMARY OF THE INVENTION

According to one aspect of the invention, a cooling system for an internal combustion engine, comprises: a cooling circuit that circulates cooling water through an internal combustion engine with a pump, a container including in reserve a quantity of a high-temperature cooling water heated by the internal combustion engine, and a controller that controls a flow rate of the cooling water within the internal combustion engine during warm up by supplying the internal combustion engine with the high-temperature cooling water reserved in the container at a flow rate greater than the flow rate of the cooling water into the internal combustion engine, and when introducing and reserving the high-temperature cooling water heated by the internal combustion engine into the container.

Another aspect of the invention according to the cooling system mentioned above includes a heating unit for heating the cooling water provided on a cooling water passageway through which the cooling water flows from the internal combustion engine to the container.

Another aspect of the invention according to the cooling system above includes cooling a drive motor that drives a water pump wherein the drive motor is controlled by a controller.

According to another aspect of the invention, a cooling method for an internal combustion engine comprises: varying the flow rate of the cooling water by setting the flow rate of the cooling water to high when the controller determines that the hot water heating control is to be performed; setting the flow rate of cooling water to low when the controller determines that the heat accumulating control is to be performed; setting the flow rate of cooling water to intermediate when the controller determines that the heating mode is to be performed.

A further aspect of the invention, according to the cooling method of an internal combustion engine comprises: varying the flow rate of cooling water with a pump driven by a drive motor that is controlled by a controller. A rotation rate of the drive motor is set to a high level and the flow rate produced by the water pump is high when the controller determines that the hot water heating control is to be performed. A rotation rate of said drive motor is set to a low level and the flow rate produced by the water pump is low when the controller determines that the heat accumulating control is to be performed. And, a rotation rate of said drive motor is set to an intermediate level and the flow rate produced by the water pump is intermediate when the controller determines that the heating mode is to be performed.

In this cooling system, when the internal combustion engine is warmed up by supplying it with the high-temperature cooling water reserved in the container, the controller increases a flow rate of the cooling water within the internal combustion engine. When the flow rate of the cooling water in the internal combustion engine increases, a heat transfer coefficient between a wall surface of the internal combustion engine and the cooling water rises. Hence, the heat from the cooling water is easily transferred to the internal combustion engine, such that the internal combustion engine can be quickly heated.

Alternatively, when introducing and reserving high-temperature cooling water in the container, the high-temperature cooling water heated by the internal combustion engine and the flow rate of the cooling water in the internal combustion engine becomes lower than in the warm-up operation. When the flow rate of the cooling water is low, the heat transfer coefficient between the wall surface of the internal combustion engine and the cooling water decreases. Therefore, a high temperature of the internal combustion engine can be produced. Further, when the flow rate of the cooling water in the internal combustion engine is low, a heat receiving time for which the cooling water receives the heat from the internal combustion engine is elongated. As a result, the temperature of the cooling water effluent from the internal combustion engine can be increased, such that the higher-temperature cooling water can be reserved in the container.

According to the invention, the controller can variably control a discharge quantity of a variable capacity pump provided in a closed circuit that connects the internal combustion engine to the container. Alternatively, the controller can control a valve provided in the closed circuit that connects the internal combustion engine to the container.

According to an exemplary embodiment the internal combustion engine is warmed up by supplying the internal combustion engine with the high-temperature cooling water reserved in the container before starting the internal combustion engine. This is because the internal combustion engine is heated before starting, and combustion of the internal combustion engine at a start of the internal combustion engine can therefore be set to a preferred state. Accordingly, a fuel consumption and an emission of exhaust gas can be improved.

According to the invention, a heating unit for heating the cooling water can be provided in a cooling water route through which the cooling water flows to the container from the internal combustion engine. In addition to heating by the exhaust heat from the internal combustion engine, the heating unit can provide heat to the cooling water. The cooling water is then introduced into the container whereby the higher-temperature cooling water can be put into the container. The heating unit can be, for example, a combustion heater that burns a fuel in a combustion chamber, different from the internal combustion engine for heating the cooling water, an electric heater, and so on.

DETAILED DESCRIPTION OF PREFERRED EMBODIMENTS

One exemplary embodiment of a cooling system of an internal combustion engine according to the present invention is described with reference to FIGS. 1 and 2.

Figure 1:
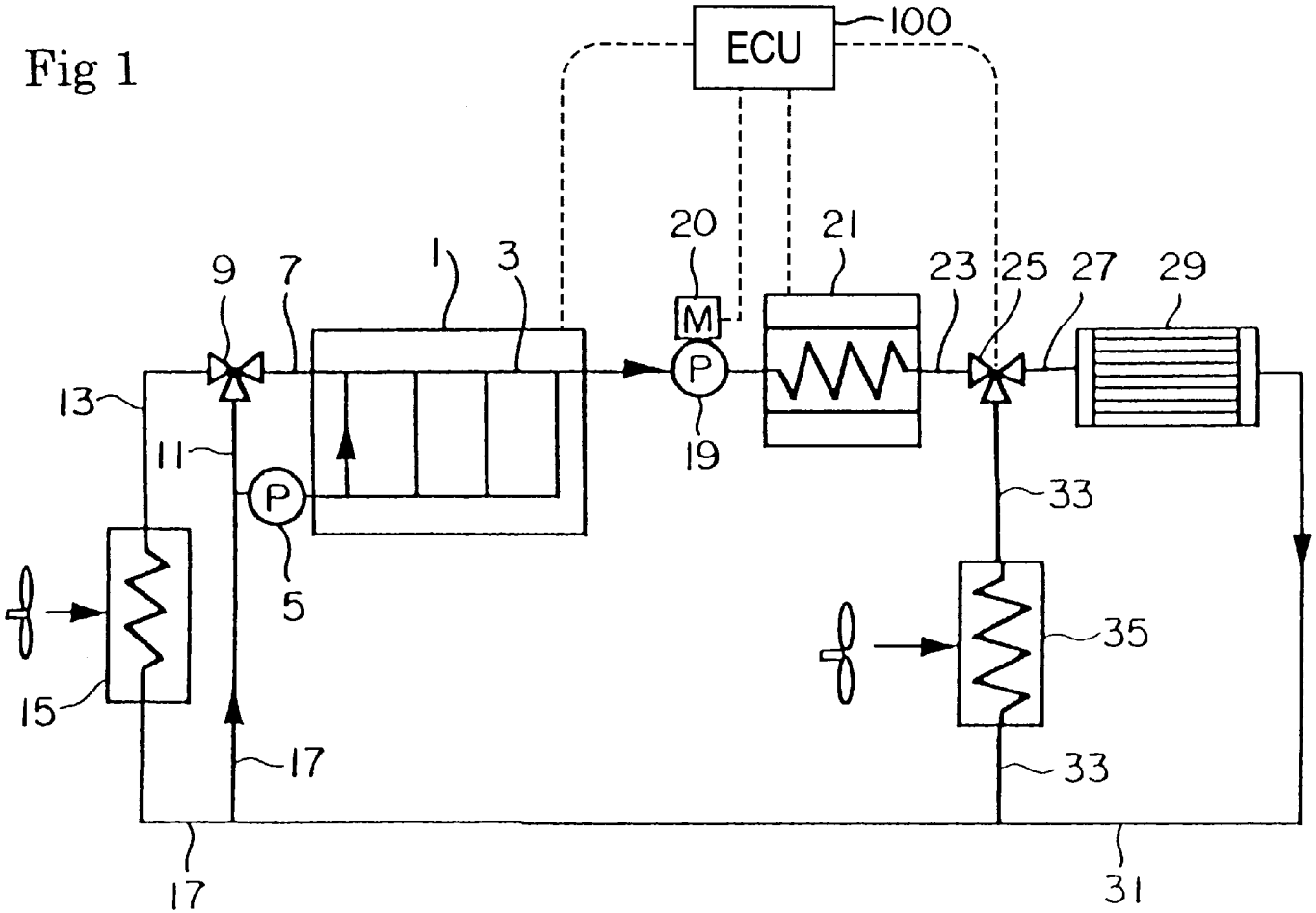
FIG. 1 is a diagram showing a first exemplary embodiment of a cooling water circuit in a cooling system of an internal combustion engine according to the invention.

FIG. 1 shows a cooling water circuit for an internal combustion engine 1, mounted in a vehicle.

The engine 1 has a cooling water passageway 3 extending therein and is cooled by cooling water flowing through the cooling water passageway 3. An upstream-side of the cooling water passageway 3 is connected to a discharge side of a first water pump 5 driven by a crank shaft (not shown) of the engine 1. The cooling water is forced to flow through the cooling water passageway 3 by the first water pump 5.

A downstream-side of the cooling water passageway 3 in the engine 1 is connected to a suction side of the first water pump 5 via a cooling water passageway 7, a thermostat valve 9 and a cooling water passageway 11. Further, the thermostat valve 9 is connected to a water inlet of a radiator 15 by a cooling water passageway 13. A water outlet of the radiator 15 is connected to the suction side of the first water pump 5 by a cooling water passageway 17. The cooling water passageways 11, 17 are connected to each other on the suction side of the first water pump 5.

The thermostat valve 9 operates to switch a flow path of the cooling water in response to a predetermined temperature of the cooling water. When the temperature of the cooling water flowing though the thermostat valve 9 is higher than a predetermined temperature $T_1$, the thermostat valve 9 closes the cooling water passageway 11 and connects the cooling water passageways 7 and 13 to each other. When the temperature of the cooling water flowing through the thermostat valve 9 is lower than the predetermined temperature $T_1$, the thermostat valve 9 closes the cooling water passageway 13 and connects the cooling water passageways 7 and 11 to each other.

Therefore, when the temperature of the cooling water is higher than the predetermined temperature $T_1$ during the operation of the engine 1, the cooling water circulates along a first closed cooling water circuit path through, e.g., the first water pump 5, the cooling water passageway 3 of the engine 1, the cooling water passageway 7, the thermostat valve 9, the cooling water passageway 13, the radiator 15, the cooling passageway 17, and back through the first water pump 5. Thus, the cooling water heated in the engine 1 is cooled off when the cooling water flows through the radiator 15.

Alternatively, when the temperature of the cooling water is lower than the predetermined temperature $T_1$ during the operation of the engine 1, the cooling water circulates along a second closed cooling water circuit path through e.g., the first water pump 5, the cooling water passageway 3 of the engine 1, the cooling water passageway 7, the thermostat valve 9, the cooling water passageway 11, and back to the first water pump 5. The flow of the cooling water along the first and second closed circuit is basic.

Further, the cooling water passageway 3 of the engine 1 can also be connected to a third closed cooling water circuit path different from the first and second closed circuits described above. For example, the downstream-side of the cooling water passageway 3 is connected to the first water pump 5 via a second water pump 19, a combustion heater (or heating means) 21, a cooling water passageway 23, a three-way switching valve 25, a cooling water passageway 27, a heat accumulating container 29, a cooling water passageway 31 and a cooling water passageway 17. The cooling water circulates along a third closed circuit through, e.g., the first water pump 5, the cooling water passageway 3 of the engine 1, the second water pump 19, the combustion heater 21, the cooling water passageway 23, the three-way switching valve 25, the cooling water passageway 27, the heat accumulating container 29, the cooling water passageway 31, the cooling water passageway 17, and back to the first water pump 5.

According to the invention, the third closed circuit is used at engine start-up. Prior to engine start-up, high-temperature cooling water heated by the engine 1 is introduced into the heat accumulating container 29 and stored in reserve therein. Upon engine start-up, the engine 1 is warmed up by the high-temperature cooling water reserved in the heat accumulating container 29.

The second water pump 19 is driven by an electric drive motor 20 and is operable before starting the engine 1. By contrast, the first water pump 5 is driven by the crank shaft of the engine 1 and is therefore inoperable before engine start-up. The second water pump 19 can be a variable capacity pump of which a discharge quantity can be controlled by controlling the number of rotations of the drive motor 20. During operation, starting, stopping and varying the number of rotations of the drive motor 20 for the second water pump 19 are controlled by a controller, or engine control unit, ECU 100.

The combustion heater 21 is a heating unit for burning a fuel in a combustion chamber, different from the engine 1, and for heating the cooling water with combustion heat. Operation of the combustion heater 21 is controlled by the ECU 100.

The heat accumulating container 29 is a container for reserving the hightemperature cooling water heated by the engine 1 and for accumulating the heat therefrom. The heat accumulating container 29 has a predetermined water holding capacity and a predetermined heat insulating performance value.

The three-way switching valve 25 is connected between cooling water passageways 23, 33 and 27. The three-way switching valve 25 is operable to bypass the heat accumulating container 29. The three-way switching valve 25 is for connecting the cooling water passageway 23 selectively to any one of the cooling water passageways 27 and 33. An operation of the three-way switching valve 25 is controlled by the ECU 100, thereby switching the flow path of the cooling water. A heater core 35 for heating an interior space of a car is provided between the cooling water passageway 33.

According to a fourth closed cooling water circuit path, cooling water circulates through, e.g., the first water pump 5, the cooling water passageway 3, the second water pump 19, the combustion heater 21, the cooling water passageway 23, the three-way switching valve 25, the cooling water passageway 33, the heater core 35, the cooling water passageway 31, the cooling water passageway 17 and back to the first water pump 5.

When a mode selection switch, such as, for example, on an air conditioning system (not shown), is set to a heating mode, the ECU 100 controls the three-way switching valve 25 to connect the cooling water passageways 23, 33 to each other. The drive motor 20 of the second water pump 19 is also controlled by the ECU 100 to operate at a preset intermediate number-of-rotations $N_2$. According to this heating mode operation, a portion of the cooling water effluent from the cooling water passageway 3 of the engine 1 can be controlled to flow along, for example, through the second water pump 19, the combustion heater 21, the cooling water passageway 23, the three-way switching valve 25, the cooling water passageway 33, the heater core 35, and the cooling water passageway 31. The cooling water becomes confluent at the cooling water passageway 17, whereby heated air is blown into the interior of the car. If the ECU 100 determines that a thermal quantity of heat given by the engine 1 is deficient in controlling a temperature in the interior of the car to a desired temperature, the ECU 100 controls the combustion heater 21 causing it to heat the cooling water such that the deficiency in the thermal quantity of heat is supplemented.

Another aspect of the invention is to use the high-temperature cooling water reserved in the heat accumulating container 29, and the heat stored therein for heating the engine 1 at start-up. Upon starting up the engine 1, the engine 1 is warmed up by delivering the high-temperature cooling water stored in reserve in the heat accumulating container 29 to the engine 1.

Initially, heat is accumulated in the heat accumulating container 29 immediately after the engine 1 has stopped. That is, when a stop signal (e.g., an OFF signal of an ignition switch) of the engine 1 is received by the ECU 100, the ECU 100 controls the three-way switching valve 25 to connect the cooling water passageways 23 and 27 to each other so that cooling water can collect heat from the engine 1 immediately after it has stopped and transfer the heat to the heat accumulating container 29. The drive motor 20 of the second water pump 19 is operated at a preset low number-of-rotations $N_3$, wherein $N_3$ is smaller than $N_2$ ($N_3<N_2$).

According to this engine stop operation, the cooling water flows along the third closed cooling water circuit path back to the cooling water passageway 3. Specifically, the cooling water flows through the cooling water passageway 3 of the engine 1, the second water pump 19, the combustion heater 21, the cooling water passageway 23, the three-way switching valve 25, the cooling water passageway 27, the heat accumulating container 29, the cooling water passageway 31, the cooling water passageway 17 and to the first water pump 5. During this operation, the engine 1, the first water pump 5, and the combustion heater 21 are not operated.

Accordingly, a quantity of the cooling water flowing to the cooling water passageway 3 of the engine 1 is equal to a discharge quantity of the second water pump 19 when the second water pump 19 is driven by the drive motor 20 rotated at the preset low number-of-rotations $N_3$. The preset low number-of-rotations $N_3$ of the drive motor 20 is comparatively low, and therefore the discharge quantity of the second water pump 19 is also small. A flow rate of the cooling water flowing through the cooling water passageway 3 of the engine 1 is low. As a result, a heat transfer coefficient decreases between a wall surface of the engine 1 that defines the cooling water passageway 3. Thus, the cooling water flowing through the cooling water passageway 3, and a temperature of the wall surface of the engine 1 can be kept high. Further, the flow rate of the cooling water flowing through the cooling water passageway 3 is set low, thereby making it possible to elongate, or increase, a heat receiving time for which the cooling water receives the heat from the wall surface of the engine 1 within the cooling water passageway 3. As a consequence, the temperature of the cooling water effluent out of the cooling water passageway 3 is raised. The higher-temperature cooling water is reserved in the heat accumulating container 29 and the heat from the higher-temperature cooling water is accumulated therein.

For example, if the temperature of the cooling water decreases, due to an operating state of the engine before the engine has stopped and due to the duration of the heating mode before the stop of the engine, the ECU 100, will control the combustion heater 21 to heat the cooling water. Heating will occur even during a period of heat accumulation, when the ECU 100 determines that the cooling water temperature detected by, e.g., a water temperature sensor (not shown), is lower than a predetermined temperature. Thus, the cooling water can be reserved in the heat accumulating container 29 even while being heated by the combustion heater 21. In the heat accumulating container 29, it is therefore possible to reserve the higher-temperature cooling water higher than a predetermined temperature and accumulate the heat thereof in a short time irrespective of many factors including, an outside temperature, vehicle traveling conditions before the engine has stopped, and whether heating is conducted or not.

Further, the cooling water passageway 3, the second water pump 19, the combustion heater 21 and the heat accumulating container 29 are disposed in series in a flow direction of the cooling water. Hence, even when the cooling water is guided to and reserved in the heat accumulating container 29, and even while being heated by the combustion heater 21, the cooling water always flows without interruption into a heat exchange unit within the combustion heater 21. Therefore, the combustion heater 21 will not be heated abnormally and overheating of the combustion heater 21 can be prevented.

A warm-up operation of the engine upon start-up is described in accordance with another aspect of the invention. When starting the engine 1, the ECU 100 controls the three-way switching valve 25 to connect the cooling water passageways 23 and 27 to each other before the starting the engine 1. At the same time, the drive motor 20 for the second water pump 19 is operated at a high preset number-of-rotations $N_1$, wherein $N_1$ is higher than $N_2$ ($N_2<N_1$).

According to this warm-up operation, the cooling water flows along the third cooling water closed circuit path back to the heat accumulating container 29. The cooling water flows through the path including: the heat accumulating container 29, the cooling water passageway 31, the cooling water passageway 17, the first water pump 5, the cooling water passageway 3, the second water pump 19, the combustion heater 21, the cooling water passageway 23, the three-way switching valve 25, and back to the cooling water passageway 27. The cooling water passageway 3, the second water pump 19, the combustion heater 21 and the heat accumulating container 29 are arranged in series along this path in the flow direction of the cooling water. Therefore, the high-temperature cooling water reserved in the heat accumulating container 29 is supplied to the cooling water passageway 3 of the engine 1. Subsequently, the cooling water is heated up to a predetermined temperature by the combustion heater 21 and is supplied to the cooling water passageway 3. Accordingly, the engine 1 is heated at a high efficiency operation.

Before starting the engine 1, the first water pump 5 is not operated. Therefore, the quantity of the cooling water flowing to the cooling water passageway 3 of the engine 1 is equal to the discharge quantity of the second water pump 19 when the second water pump 19 is driven by the drive motor 20 rotated at the preset number-of-rotations $N_1$. Since the preset number-of-rotations $N_1$ of the drive motor 20 is comparatively high, the discharge quantity of the second water pump 19 is also large. Accordingly, the flow rate of the cooling water flowing through the cooling water passageway 3 of the engine 1 also increases. As a result, the heat transfer coefficient between the wall surface of the engine 1 that defines the cooling water passageway 3 and the cooling water flowing through the cooling water passageway 3 increases. Thus, heat from the cooling water is easily transferred to the wall surface of the engine 1. Consequently, the engine 1 is quickly heated, and an early warm-up can be attained.

After completion of the warm-up operation of the engine 1 has finished, the ECU 100 controls the three-way switching valve 25 to connect the cooling water passageways 23 and 33 to each other, and stops the drive motor 20 of the second water pump 19. At the same time, the engine 1 is started, e.g., by automatically actuating a starter motor (not shown). A determination of the completion of the warm-up is made when an operating time of the second water pump 19 reaches a predetermined time.

Thus, the engine 1 is warmed up before starting the engine 1, such that a preferred combustion state in the combustion chamber of the engine 1 is attained when starting the engine 1. Improved fuel consumption at the start of the engine and a preferable reduction in the emission of the exhaust gas is obtained at the start of the engine.

Moreover, even when set in the heating mode at the start of the engine, a decrease in the temperature of the cooling water due to heat radiation in the heater core 35 can be supplemented with heat from the cooling water by the combustion heater 21. Thus, prompt heating immediately after the start-up can be attained without deteriorating the combustion state of the engine 1.

Figure 2:
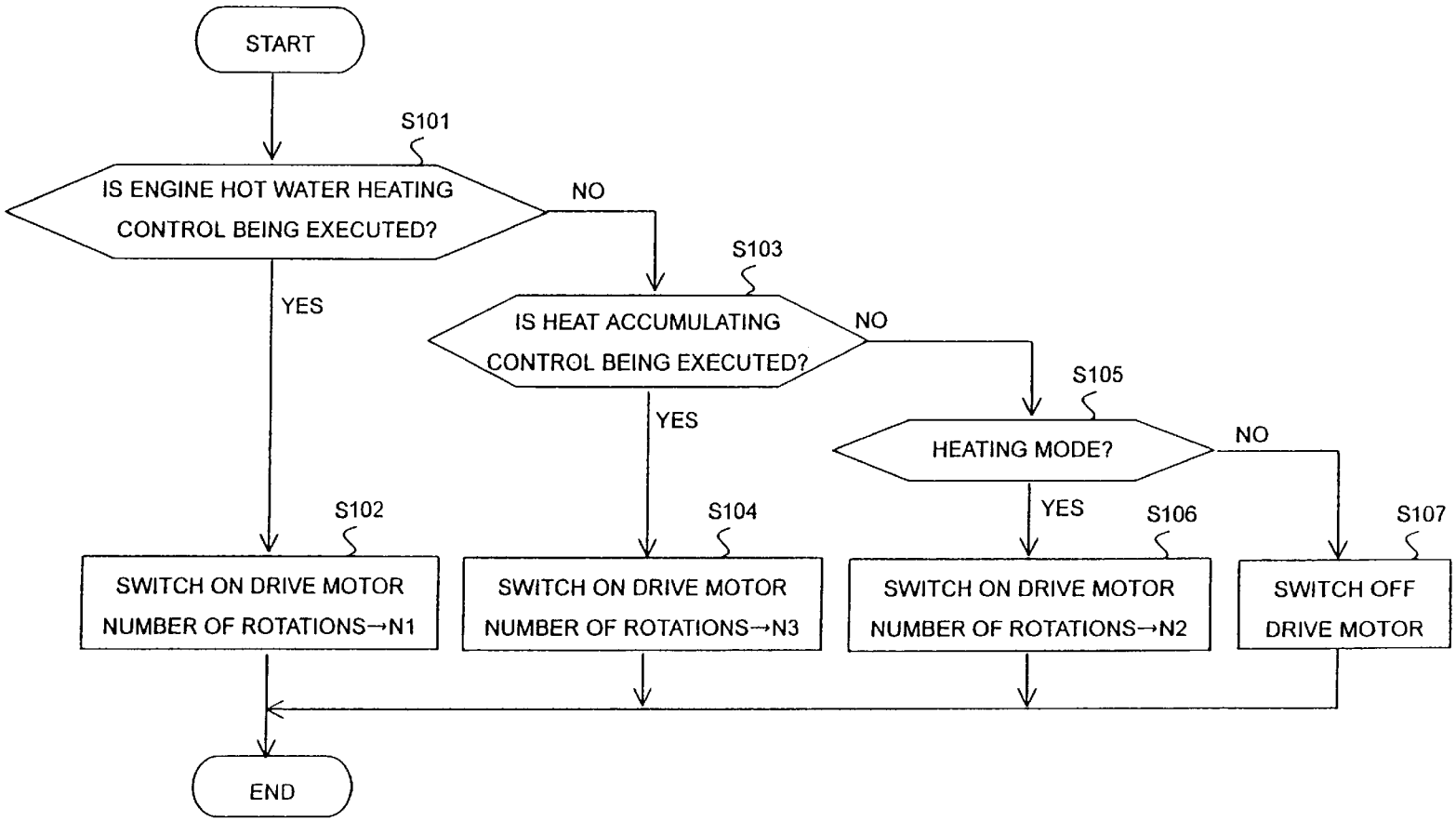
FIG. 2 is a flowchart showing an operation control routine of a drive motor for a second water pump according to the exemplary embodiment.

FIG. 2 is an exemplary flowchart of an operation control routine of the drive motor for the second water pump according to the invention.

The operation control routine is repeatedly executed by an ECU at a predetermined interval of time. A cooling water flow rate increasing operation is performed in response to the ECU executing the operation control routine of the drive motor connected to the second water pump.

In step S101, the ECU determines whether the engine hot water heating control is being executed. That is, whether high-temperature cooling water reserved in the heat accumulating container is heating the engine 1. If yes, the control routine advances to step S102, otherwise the control routine jumps to step S103.

In step S102, the drive motor for the second water pump is switched on and rotated at a preset high number-of-rotations $N_1$. Then, execution of this routine temporarily ends. As discussed above, the discharge quantity of the second water pump is increased, and the flow rate of the cooling water flowing through the cooling water passageway of the engine rises. The engine is therefore quickly heated up.

In step S103, the ECU determines whether heat accumulating control is being executed. If yes, the control routine advances to step S104, otherwise the control routine jumps to step S105. In step S103, the high-temperature cooling water heated by the engine is reserved in the heat accumulating container and the heat from the high-temperature cooling water is also accumulated therein. The control routine then advances to step S104.

In step S104, the drive motor for the second water pump is switched on and rotated at a preset low number-of-rotations $N_3$. As described above, the discharge quantity of the second water pump is diminished, and the flow rate of the cooling water circulating through the cooling water passageway of the engine is thereby decreased. The temperature of the cooling water effluent out of the cooling water passageway of the engine is therefore raised, and the heat of the high-temperature cooling water is accumulated in the heat accumulating container. Then, execution of this routine temporarily ends.

In step S105, the ECU determines whether the mode selection switch of the air conditioning system is set in the heating mode. If yes, the control routine advances to step S106, otherwise the control routine jumps to step S107.

In step S106, the ECU operates the drive motor for the second water pump at a predetermined intermediate number-of-rotations $N_2$. Then, the execution of this routine temporarily ends.

In step S107, the ECU stops the second water pump by switching off the drive motor, and temporarily finishes the execution of this routine. According to this step S107, the cooling water does not flow to either, the heat accumulating container or the heater core.

Various other exemplary embodiments according to the invention are possible. In the embodiment discussed above, upon start up of the engine 1, the engine 1 is heated by the high-temperature cooling water reserved in the heat accumulating container 29 by operating the combustion heater 21 while heating the cooling water. The engine 1 can be sufficiently heated by supplying the cooling water passageway 3 of the engine 1 with the high-temperature cooling water reserved in the heat accumulating container 29, even while the combustion heater 21 is not operating.

Further, in the embodiment discussed above, the heat accumulating process is executed immediately after the engine 1 has been halted. Alternatively, the heat accumulating process may be executed during the operation of the engine 1. In the heat accumulating process, high-temperature cooling water heated by the engine 1 is introduced into the heat accumulating container 29 and its heat is accumulated therein. In this situation, heat can also be accumulated while heating the cooling water by operating the combustion heater 21 when the situation arises.

In the embodiment discussed above, one mode of changing the flow rate of the cooling water flowing through the cooling water passageway 3 of the engine 1 is by variably discharging a quantity of the cooling water from the second water pump 19 by changing the number of rotations of the drive motor 20. Alternatively, a flow quantity control valve (not shown) can be provided midway of the cooling water passageway 31. And, the flow rate of the cooling water flowing through the cooling water passageway 3 can be controlled by controlling the flow quantity control valve without changing the number of rotations of the drive motor 20 for the second water pump 19.

In the embodiments discussed above, the crank shaft of the engine 1 is used as the drive source for the first water pump 5. However, the first water pump 5 can also be driven by an electric motor and controlled by the ECU 100. The first water pump 5 can be constructed as a variable capacity pump capable of making the discharge quantity variable by changing the number of rotations of the electric motor. Thus, the flow rate of the cooling water flowing through the cooling water passageway 3 can be varied by changing the number of rotations of the drive motor for the first water pump 5. According to this embodiment, the application of the second water pump 19 is unnecessary.

Alternatively, application of the second water pump 19 may also be unnecessary when the first water pump 5 is driven by an electric motor controlled by the ECU such that and the flow rate of the cooling water flowing through the cooling water passageway 3 is changed by controlling the flow quantity control valve.

What is claimed is:

1. A cooling system for an internal combustion engine, comprising:

(a) a pump that is controlled to circulate cooling water in a cooling circuit that includes the internal combustion engine;

(b) a container that reserves high-temperature cooling water heated by said internal combustion engine; and (c) a cooling water unit adapted to provide a higher flow rate through the internal combustion engine and the container when transferring heat from the high-temperature cooling water reserved in the container to the internal combustion engine during warm up, than when introducing and reserving the high-temperature cooling water heated by said internal combustion engine into said container, wherein the warm up is conducted before cranking of the internal combustion engine and the cooling water unit is adapted to provide at least a high flow rate when a hot water heating control is to be performed, and a low flow rate when a heat accumulating control is to be performed.

2. The cooling system according to claim 1, further comprising a heating unit that heats the cooling water is disposed in a cooling water passageway through which the cooling water flows from the engine to the container.

3. The cooling system according to claim 1, wherein the cooling system further comprises a motor that drives the pump, wherein the motor is controlled by the controller.

4. A cooling method for an internal combustion engine including a controller, the method comprising:

varying the flow rate of cooling water in a cooling circuit of an internal combustion engine by:

setting the flow rate of the cooling water to high when the controller determines that a hot water heating control is to be performed in which heat from a high-temperature cooling water reserved in a container is transferred to the internal combustion engine;

setting the flow rate of the cooling water to low when the controller determines that a heat accumulating control is to be performed in which heat from the internal combustion engine is transferred to the cooling water in the container; and setting the flow rate of the cooling water to intermediate when the controller determines that a heating mode is to be performed in which heat is transferred from the high-temperature cooling water to a heater core for heating an interior of a car room.

5. The cooling method according to claim 4, further comprising:

varying the flow rate of the cooling water with a pump driven by a drive motor, wherein the drive motor is controlled by a controller such that:

a rotation rate of the drive motor is set to a high level and the flow rate produced by the pump is high when the controller determines that the hot water heating control is to be performed;

a rotation rate of the drive motor is set to a low level and the flow rate produced by the pump is low when the controller determines that the heat accumulating control is to be performed; and a rotation rate of the drive motor is set to an intermediate level and the flow rate produced by the pump is intermediate when the controller determines that the heating mode is to be performed.

6. A cooling system for an internal combustion engine, comprising:

a pump that is controlled to circulate cooling water in a cooling circuit that includes the internal combustion engine;

a container including in reserve a quantity of a high-temperature cooling water heated by said internal combustion engine, wherein the high-temperature cooling water is a portion of the cooling water in the cooling circuit; and a controller adapted to provide a higher flow rate through the engine and the container when transferring heat from the container to the engine during warm up, than when transferring heat from the engine into the container, wherein the warm up is conducted before cranking of the internal combustion engine, the controller is adapted to provide a high flow rate when the controller determines that a hot water heating control is to be performed, and a low flow rate when a heat accumulating control is to be performed.

7. A cooling system for an internal combustion engine, comprising:

(a) a pump that is controlled to circulate cooling water in a cooling circuit that includes the internal combustion engine;

(b) a container that reserves high-temperature cooling water heated by said internal combustion engine; and (c) a cooling water unit adapted to provide a higher flow rate through the internal combustion engine and the container when transferring heat from the high-temperature cooling water reserved in the container to the internal combustion engine during warm up, than when introducing and reserving the high-temperature cooling water heated by said internal combustion engine into said container, wherein the warm up is conducted before cranking of the internal combustion engine and the cooling water unit is adapted to provide at least a high flow rate when a hot water heating control is to be performed, an intermediate flow rate when the heating mode is to be performed, and a low flow rate when a heat accumulating control is to be performed.

8. A cooling system for an internal combustion engine, comprising:

a pump that is controlled to circulate cooling water in a cooling circuit that includes the internal combustion engine;

a container including in reserve a quantity of a high-temperature cooling water heated by said internal combustion engine, wherein the high-temperature cooling water is a portion of the cooling water in the cooling circuit; and a controller adapted to provide a higher flow rate through the engine and the container when transferring heat from the container to the engine during warm up, than when transferring heat from the engine into the container, wherein the warm up is conducted before cranking of the internal combustion engine, the controller is adapted to provide a high flow rate when the controller determines that a hot water heating control is to be performed, an intermediate flow rate when the heating mode is to be performed, and a low flow rate when a heat accumulating control is to be performed.

9. A cooling system for an internal combustion engine according to claim 8, wherein the heat accumulating process of introducing the high-temperature cooling water heated by the engine into the heat accumulating container and accumulating its heat therein, is executed after the halt of the engine.

10. A cooling system for an internal combustion engine according to claim 8, wherein the pump is driven by a motor before cranking of the internal combustion engine.

* * * * *